US011236758B2

(12) United States Patent
Nagao et al.

(10) Patent No.: US 11,236,758 B2
(45) Date of Patent: Feb. 1, 2022

(54) IMPELLER AND ROTARY MACHINE

(71) Applicant: MITSUBISHI HEAVY INDUSTRIES COMPRESSOR CORPORATION, Tokyo (JP)

(72) Inventors: Hideki Nagao, Hiroshima (JP); Akihiro Nakaniwa, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 17/125,044

(22) Filed: Dec. 17, 2020

(65) Prior Publication Data

US 2021/0190088 A1 Jun. 24, 2021

(30) Foreign Application Priority Data

Dec. 20, 2019 (JP) ..... JP2019-230298

(51) Int. Cl.
*F04D 29/28* (2006.01)
*F04D 29/22* (2006.01)

(52) U.S. Cl.
CPC ..... *F04D 29/284* (2013.01); *F04D 29/2261* (2013.01)

(58) Field of Classification Search
CPC ..... F04D 29/284; F04D 29/2261; F04D 29/2294; F04D 29/30
See application file for complete search history.

(56) References Cited

U.S. PATENT DOCUMENTS

2005/0152779 A1* 7/2005 Williams ..... F04D 29/2294 415/206

FOREIGN PATENT DOCUMENTS

| | | | |
|---|---|---|---|
| DE | 2622018 | A1 | 12/1977 |
| DE | 4220227 | A1 | 12/1993 |
| JP | 2011-122516 | A | 6/2011 |

* cited by examiner

*Primary Examiner* — Audrey B. Walter
*Assistant Examiner* — Edward Bushard
(74) *Attorney, Agent, or Firm* — Osha Bergman Watanabe & Burton LLP

(57) ABSTRACT

An impeller includes a disk that has a disk shape centered on an axis, a cover that is disposed to be separated from the disk in an axial direction in which the axis extends, a plurality of blades that connect the disk and the cover to each other and are disposed at intervals in a circumferential direction around the axis, and a connection member that is disposed to be separated from the plurality of blades in the axial direction and connects the disk and the cover to each other. A plurality of the connection members are disposed at intervals in the circumferential direction at positions near an inlet of an impeller flow path with respect to front edges of the blades positioned at positions near the inlet, the impeller flow path being formed between the disk and the cover.

6 Claims, 8 Drawing Sheets

IMPELLER AND ROTARY MACHINE

BACKGROUND OF THE INVENTION

Field of the Invention

The present disclosure relates to an impeller and a rotary machine.

Priority is claimed on Japanese Patent Application No. 2019-230298, filed on Dec. 20, 2019, the content of which is incorporated herein by reference.

Description of Related Art

As a rotary machine used for an industrial compressor, a turbo refrigerator, a small gas turbine, or the like, a rotary machine that is provided with an impeller obtained by attaching a plurality of blades to a disk fixed to a rotary shaft is known. In the case of the above-described rotary machine, pressure energy and speed energy are applied to a gas when the impeller is rotated.

For example, Japanese Unexamined Patent Application, First Publication No. 2011-122516 discloses a centrifugal compressor including an impeller. The impeller is a so-called closed impeller including a disk, a plurality of blades provided on the disk, and a cover provided to cover the plurality of blades.

SUMMARY OF THE INVENTION

At a portion of the impeller where the plurality of blades are provided, the cover is connected and bonded to the disk by means of the plurality of blades so that a high rigidity is achieved. On the other hand, at a cover inner peripheral portion where the cover extends radially inward further than the plurality of blades, the rigidity of the cover is low in comparison with a portion connected to the plurality of blades. In addition, when an attempt is made to increase the rotation rate of the impeller for the purposed of improving the performance of the rotary machine, there is an increase in centrifugal force acting on the cover of the impeller. When the thickness of the cover inner peripheral portion is increased in preparation for the increase in centrifugal force, the rigidity of the cover inner peripheral portion is increased, the weight thereof is increased, and the influence of the centrifugal force is increased.

The present disclosure provides an impeller and a rotary machine with which it is possible to suppress the influence of a centrifugal force acting on a cover while achieving an increase in rigidity.

An aspect of the present disclosure provides an impeller including a disk that has a disk shape centered on an axis, a cover that is disposed to be separated from the disk in an axial direction in which the axis extends, a plurality of blades that connect the disk and the cover to each other and are disposed at intervals in a circumferential direction around the axis, and at least one connection member that is disposed to be separated from the plurality of blades in the axial direction and connects the disk and the cover to each other. The at least one connection member includes a plurality of connection members which are disposed at intervals in the circumferential direction at positions near an inlet of an impeller flow path with respect to front edges of the blades positioned at positions near the inlet, the impeller flow path being formed between the disk and the cover.

With the impeller and a rotary machine according to the aspect of the present disclosure, it is possible to suppress the influence of a centrifugal force acting on a cover while achieving an increase in rigidity.

DETAILED DESCRIPTION OF THE INVENTION

Hereinafter, an embodiment of an impeller and a rotary machine according to the present disclosure will be described with reference to the accompanying drawings. However, the present disclosure is not limited only to the embodiment.

(Configuration of Centrifugal Compressor)

Figure 1:
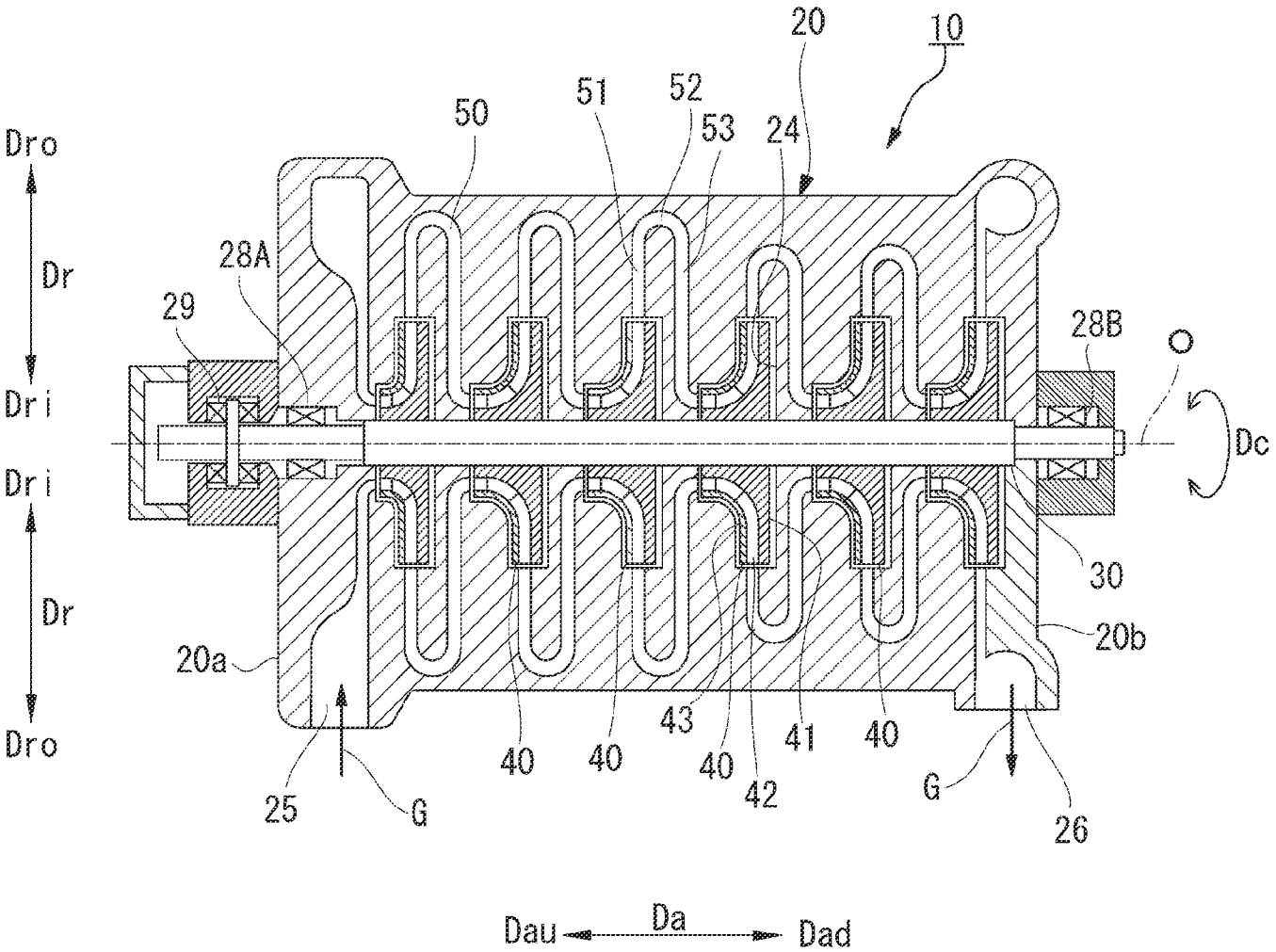
FIG. 1 is a sectional view showing a configuration of a rotary machine according to an embodiment of the present disclosure.

Hereinafter, an impeller and a rotary machine according to an embodiment of the present disclosure will be described with reference to FIGS. 1 to 5. As shown in FIG. 1, a centrifugal compressor (rotary machine) 10 mainly includes a casing 20, a rotary shaft 30, and impellers 40.

(Configuration of Casing)

The casing 20 accommodates a portion of the rotary shaft 30 and the impellers 40. The casing 20 has a tubular shape extending in a direction in which an axis O of the rotary shaft 30 extends (hereinafter, this direction will be referred to as axial direction Da). The casing 20 is provided with an internal space 24 of which the diameter is increased and decreased repeatedly. The impellers 40 are accommodated in the internal space 24.

In the casing 20, a suction port 25, through which a process gas (working fluid) G from the outside flows into the casing 20, is formed at a position near a first end portion 20*a* that is on a first side Dau in the axial direction Da. In addition, in the casing 20, a discharge port 26, through which the process gas G flows to the outside of the casing 20, is formed at a position near a second end portion 20*b* that is on a second side Dad in the axial direction Da.

In the casing 20, casing side flow paths 50 are formed between the impellers 40. Through the casing side flow paths 50, the process gas G passing through the impellers 40 flows from the first end portion 20*a* side (upstream side) that is on the first side Dau in the axial direction Da to the second end portion 20*b* side (downstream side) that is on the second side Dad in the axial direction Da, in the casing 20.

Each casing side flow path 50 includes a diffuser portion 51, a return bend portion 52, and a return flow path 53. The diffuser portion 51 extends toward an outer side Dro in a radial direction Dr around an axis O from an outer peripheral end of the impeller 40. The return bend portion 52 continuously extends from an outer peripheral end of the diffuser portion 51. The return bend portion 52 extends around in a U-shape as seen in sectional view from the outer peripheral end of the diffuser portion 51 and extends to an inner side Dri in the radial direction Dr. The return bend portion 52 reverses a direction, in which the process gas G that is discharged from the impeller 40 toward the outer side Dro in the radial direction Dr flows, such that the process gas G is guided to the inner side Dri in the radial direction Dr. The return flow path 53 extends toward the inner side Dri in the radial direction Dr from the return bend portion 52.

(Configuration of Rotary Shaft)

The rotary shaft 30 can rotate around the axis O with respect to the casing 20. Opposite ends of the rotary shaft 30 are supported by journal bearings 28A and 28B such that the opposite ends can rotate around the axis O. In addition, at the first end portion 20*a* of the casing 20, a thrust bearing 29 is disposed at a position near the journal bearing 28A. One end side of the rotary shaft 30 is supported by the thrust bearing 29 in the axial direction Da.

(Configuration of Impeller)

A plurality of the impellers 40 are attached to the rotary shaft 30 and compress the process gas G by using a centrifugal force. The plurality of impellers 40 are accommodated in the casing 20 at intervals in the axial direction Da. Note that, in the embodiment of the present disclosure, FIG. 1 shows an example in which six impellers 40 are disposed. However, it is sufficient that at least one or more impellers 40 are disposed.

Figure 2:
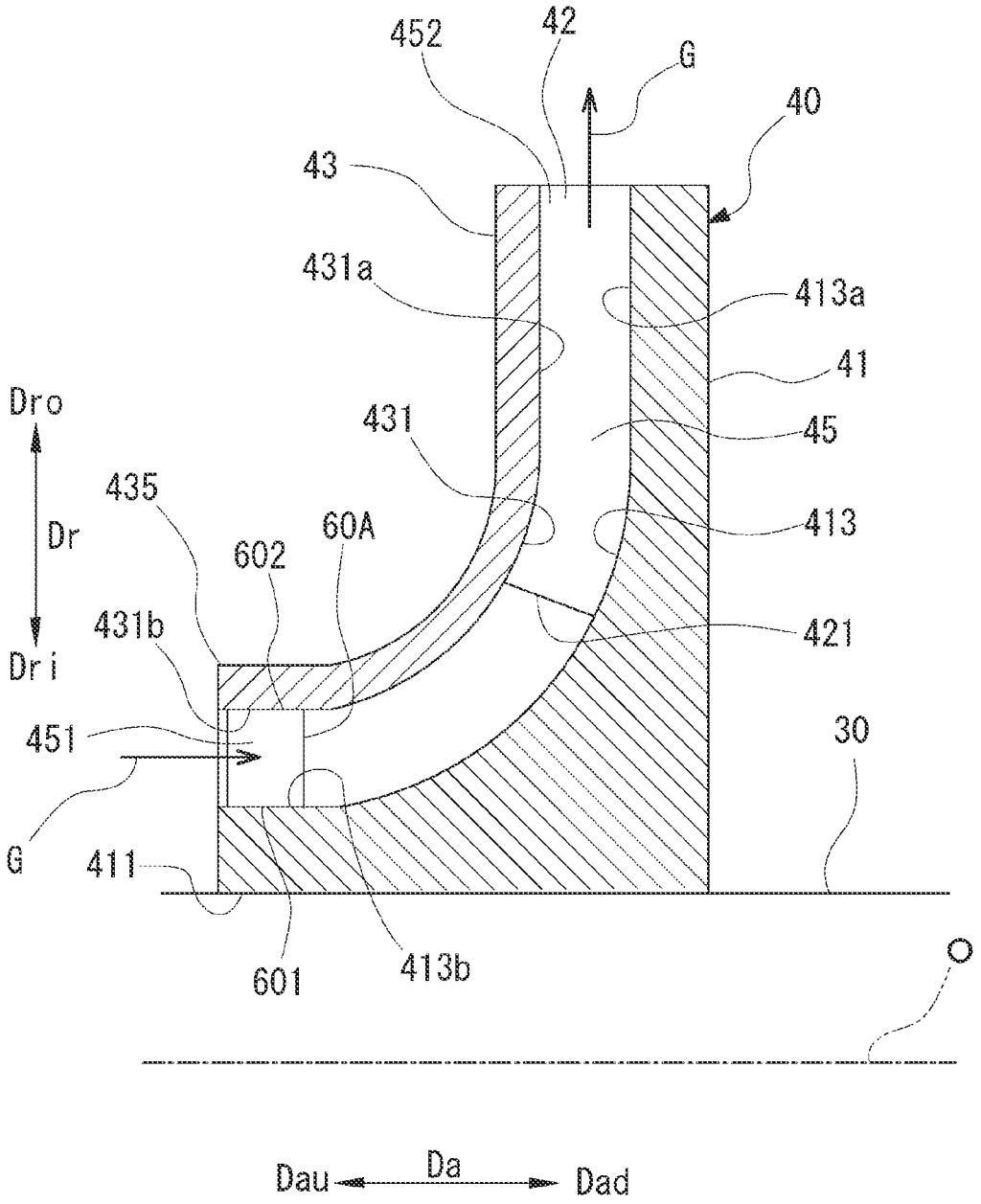
FIG. 2 is a sectional view showing the meridional shape of an upper half portion of an impeller provided in the rotary machine.
Figure 3:
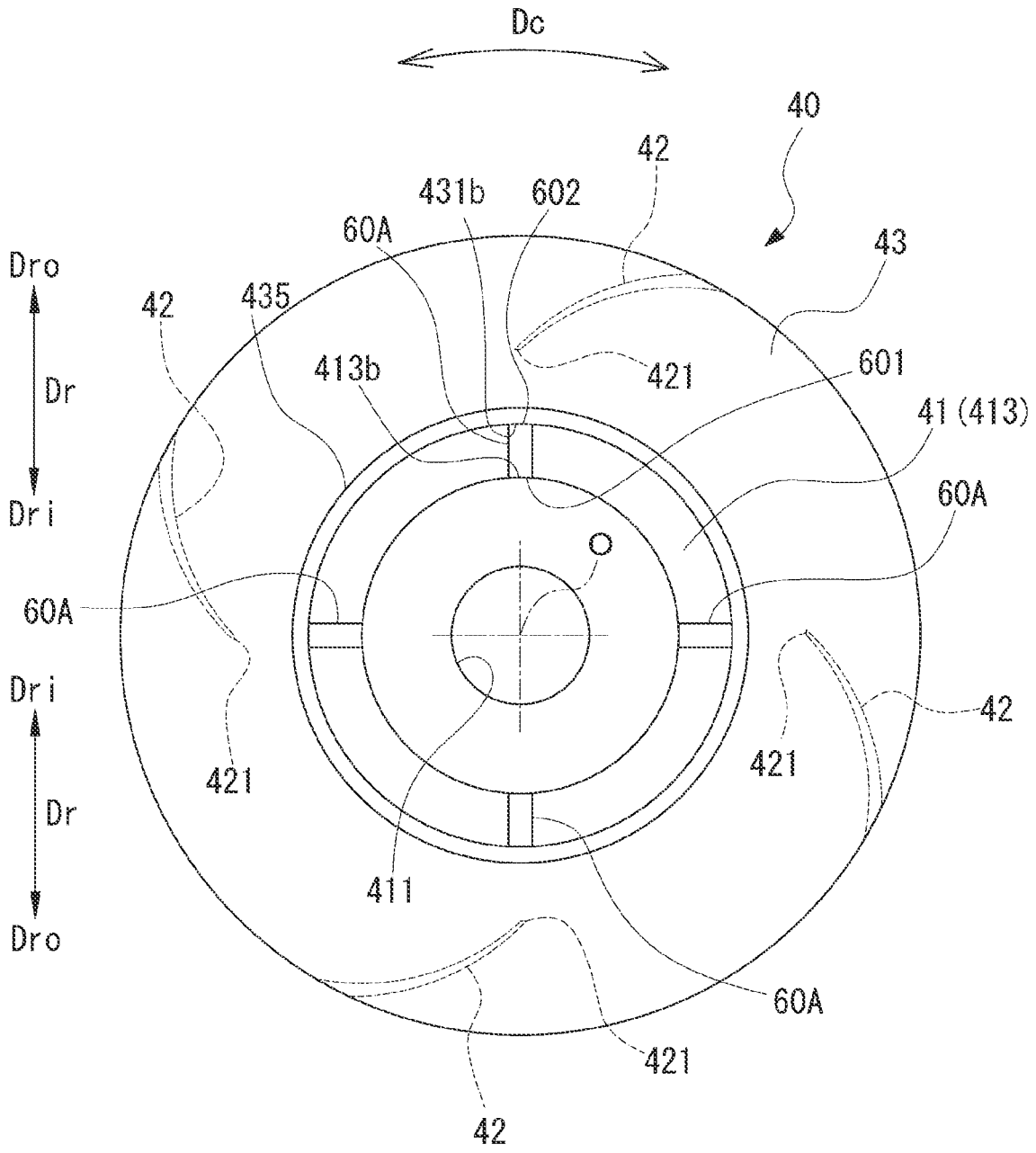
FIG. 3 is a view showing the impeller as seen from a first side in an axial direction.

As shown in FIGS. 2 and 3, each impeller 40 is a so-called closed impeller including a disk 41, blades 42, and a cover 43.

(Configuration of Disk)

The disk 41 is formed in a disk shape centering on the axis O. The disk 41 is formed such that the diameter thereof gradually increases to the outer side Dro in the radial direction Dr toward the second side Dad from the first side Dau in the axial direction Da.

A through-hole 411 that has a circular shape and penetrates the disk 41 in the axial direction Da is formed in a central portion of the disk 41. The impeller 40 is integrally fixed to the rotary shaft 30 with an inner surface of the through-hole 411 fitted onto an outer peripheral surface of the rotary shaft 30.

At a portion of the disk 41 that is on the first side Dau in the axial direction Da, a disk main surface 413 is formed. The disk main surface 413 expands to the outer side Dro in the radial direction Dr toward the second side Dad from the first side Dau in the axial direction Da. At a portion on the first side Dau in the axial direction Da, the disk main surface 413 faces the outer side Dro in the radial direction Dr. At a portion on the second side Dad in the axial direction Da, the disk main surface 413 faces the first side Dau in the axial direction Da. That is, the disk main surface 413 is curved such that the disk main surface 413 faces the first side Dau toward the second side Dad from the first side Dau in the axial direction Da. That is, the disk main surface 413 has a concave curved surface shape.

(Configuration of Blades)

The blades 42 connect the disk 41 and the cover 43 to each other. The blades 42 extend to the first side Dau in the axial direction Da from the disk main surface 413. A plurality of the blades 42 are disposed at intervals in a circumferential direction Dc around the axis O. The plurality of blades 42 are radially arranged around the axis O to face the outer side Dro in the radial direction Dr. Each blade 42 is rearwardly curved in a rotation direction of the impeller 40 toward the outer side Dro in the radial direction Dr from the inner side Dri in the radial direction Dr. The blades 42 are connected to a portion 413*a* of the disk main surface 413 that is positioned on the second side Dad in the axial direction Da and faces the first side Dau in the axial direction Da.

(Configuration of Cover)

The cover 43 is disposed to be separated from the disk 41 at the first side Dau in the axial direction Da. The cover 43 covers the plurality of blades 42 from the first side Dau in the axial direction Da. End portions of the blades 42 that are on a side opposite to end portions connected to the disk main surface 413 are fixed to the cover 43. The cover 43 is disposed to face the disk 41 such that the blades 42 are interposed between the cover 43 and the disk 41. The cover 43 is formed such that the diameter thereof gradually increases to the outer side Dro in the radial direction Dr toward the second side Dad from the first side Dau in the axial direction Da. At a portion of the cover 43 that is on the second side Dad in the axial direction Da, a cover facing surface 431 that faces the disk main surface 413 is formed. The cover facing surface 431 expands to the outer side Dro in the radial direction Dr toward the second side Dad from the first side Dau in the axial direction Da. At a portion on the first side Dau in the axial direction Da, the cover facing surface 431 faces the outer side Dro in the radial direction Dr. At a portion on the second side Dad in the axial direction Da, the cover facing surface 431 faces the second side Dad in the axial direction Da. That is, the cover facing surface 431 is curved such that the cover facing surface 431 faces the second side Dad toward the second side Dad from the first side Dau in the axial direction Da. That is, regarding the cover facing surface 431, the blades 42 having a convex curved surface shape are bonded to a portion 431*a* of the cover facing surface 431 that is positioned on the second side Dad in the axial direction Da and faces the second side Dad in the axial direction Da.

Impeller flow paths 45 separated from each other by the plurality of blades 42 in the circumferential direction Dc are formed between the disk 41 and the cover 43. The impeller flow paths 45 extend while being curved from the inner side Dri in the radial direction Dr to the outer side Dro toward the second side Dad from the first side Dau in the axial direction Da. Each impeller flow path 45 includes an inlet 451 that is open on the inner side Dri in the radial direction Dr and the first side Dau in the axial direction Da and an outlet 452 that is open on the outer side Dro in the radial direction Dr and the first side Dau in the axial direction Da. The inlet 451 is open toward the first side Dau in the axial direction Da so that the process gas G flowing through the return flow path 53 can flow thereinto. The outlet 452 is open toward the outer side Dro in the radial direction Dr such that the process gas G flows out to the diffuser portion 51.

(Configuration of Connection Members)

As shown in FIGS. 2 and 3, the impeller 40 further includes connection members 60A. The connection members 60A connect the disk 41 and the cover 43 to each other. A plurality of the connection members 60A are disposed at intervals in the circumferential direction Dc. The connection members 60A are disposed on the first side Dau in the axial direction Da at positions separated from the plurality of blades 42. Specifically, in the axial direction Da, the connection members 60A are disposed at positions near the inlets 451 with respect to front edges 421 of the blades 42 that are positioned at positions near the inlets 451. The number of the connection members 60A disposed is the same as the number of the blades 42. Disk side end portions 601, which are end portions of the connection members 60A that are on the inner side Dri in the radial direction Dr, are connected to the disk main surface 413. The disk side end portions 601 are connected to a portion 413*b* of the disk main surface 413 that faces the outer side Dro in the radial direction Dr on the first side Dau in the axial direction Da. In addition, cover side end portions 602, which are end portions of the connection members 60A that are on the outer side Dro in the radial direction Dr, are connected to the cover facing surface 431. The cover side end portions 602 are connected to a portion 431*b* of the cover facing surface 431 that faces the inner side Dri in the radial direction Dr on the first side Dau in the axial direction Da. In this manner, the connection members 60A are connected to a cover inner peripheral edge portion 435 that is positioned closest to the inner side Dri in the radial direction Dr in the cover 43.

Figure 4:
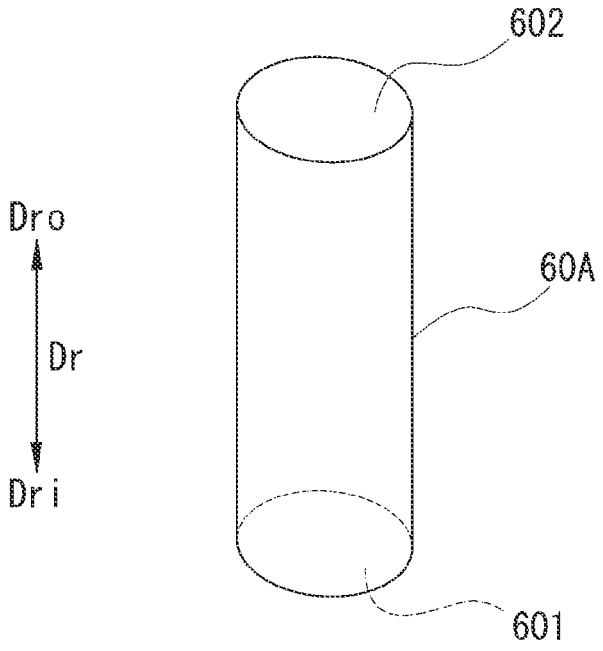
FIG. 4 is a perspective view showing the shape of a connection member provided on the impeller.

Each connection member 60A is provided such that the disk side end portion 601 and the cover side end portion 602 are linearly connected to each other. As shown in FIG. 2, the meridional shape of the connection member 60A extends to be perpendicular to the axis O. That is, as seen in a meridional cross-section, an imaginary central line of the connection member 60A extends straight in the radial direction Dr. Therefore, the connection member 60A is perpendicularly connected with respect to the disk side end portion 601 and the cover side end portion 602. Here, a meridional shape means a shape as seen in the meridional cross-section which is a cross-section passing through the meridian and the axis O of the impeller 40 that is circular as seen in the axial direction Da. A section of the connection member 60A that is parallel to the axial direction Da has the same shape over a range from the disk side end portion 601 to the cover side end portion 602. As shown in FIG. 4, in the embodiment of the present disclosure, the shape of a section of the connection member 60A in the axial direction Da (section orthogonal to extending direction of connection member 60A) is circular. That is, the connection member 60A has a columnar shape extending from the disk side end portion 601 to the cover side end portion 602. Note that, the extending direction is a direction in which an imaginary line connecting the disk side end portion 601 and the cover side end portion 602 to each other extends.

Figure 5:
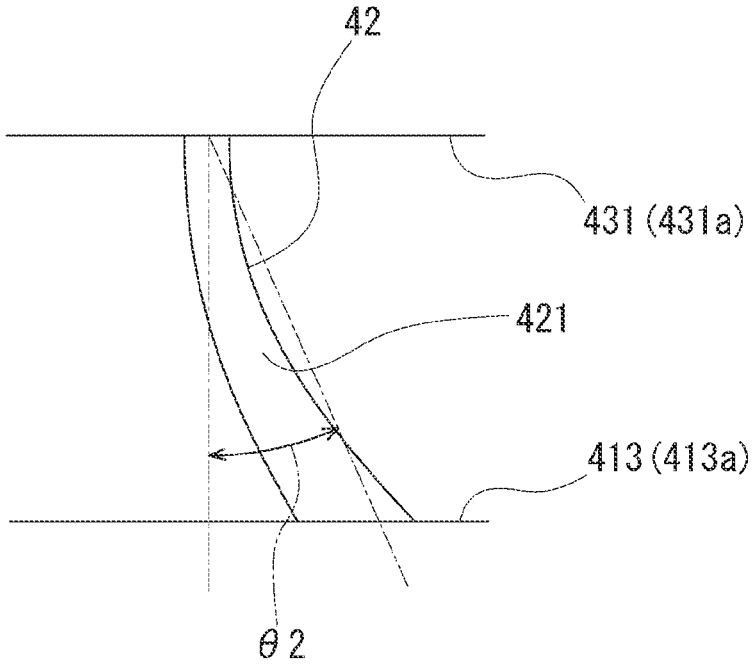
FIG. 5 is a view showing a front edge of a blade provided in the impeller as seen in the axial direction.

As shown in FIG. 2, as seen in the radial direction Dr, the disk side end portion 601 and the cover side end portion 602 of the connection member 60A are disposed at the same position in the axial direction Da. Furthermore, as shown in FIG. 3, as seen in the axial direction Da, the disk side end portions 601 and the cover side end portions 602 are disposed at the same positions in the circumferential direction Dc. That is, regarding each connection member 60A, the extending direction in which the disk side end portion 601 and the cover side end portion 602 are connected to each other coincides with the radial direction Dr. That is, the connection member 60A extends straight in the radial direction Dr such that the angle of inclination of the connection member 60A with respect to the radial direction Dr is 0°. With regard to this, as shown in FIG. 5, as seen in the axial direction Da, the front edge 421 of each blade 42 is inclined with respect to the radial direction Dr. Therefore, as seen in the axial direction Da, the connection member 60A extends such that the angle of inclination of the connection member 60A with respect to the radial direction Dr is smaller than an angle of inclination θ2 of the front edge 421 with respect to the radial direction Dr.

(Effect)

In the case of the impeller 40 described as above, the disk 41 and the cover 43 are connected to each other by means of the plurality of connection members 60A independently of the blades 42. Furthermore, the connection members 60A are disposed at positions closer to the first side Dau in the axial direction Da than the front edges 421 of the plurality of blades 42 that are on the first side Dau in the axial direction Da while being separated from the front edges 421. Accordingly, the cover 43 is supported by the plurality of connection members 60A at a portion closer to the first side Dau in the axial direction Da than the plurality of blades 42. Therefore, the rigidity of a portion of the cover 43 that is closer to the first side Dau in the axial direction Da than the plurality of blades 42 is made high without an increase in weight of the cover 43. As a result, it is possible to suppress the influence of a centrifugal force acting on the cover 43 while achieving an increase in rigidity of the cover 43 in a region where no blade 42 is disposed. Accordingly, it is possible to increase the rotation rate of the impeller 40.

In addition, the meridional shape of each connection member 60A extends straight to be perpendicular to the axis O. As a result, the rigidity of the connection member 60A can be improved in comparison with a case where the meridional shape extends obliquely to be inclined with respect to the axis O (does not extend straight in radial direction Dr). Accordingly, it is possible to effectively suppress the influence of a centrifugal force (stress caused by centrifugal load) acting on the cover 43.

In addition, as seen in the axial direction Da, the angle of inclination of the connection member 60A is smaller than the angle of inclination θ2 of the front edge 421 of the blade 42. Therefore, it is possible to more efficiently support the cover 43 and to effectively increase the rigidity of the cover 43 against a centrifugal force acting in the radial direction Dr.

In addition, the disk side end portion 601 and the cover side end portion 602 of each connection member 60A are disposed at the same position in the axial direction Da and the circumferential direction Dc. That is, it is possible to make the connection member 60A extend straight in the radial direction Dr. Accordingly, with the connection member 60A, it is possible to more efficiently support the cover 43 and to effectively increase the rigidity of the cover 43 against a centrifugal force acting in the radial direction Dr.

In addition, the connection members 60A are connected to the cover 43 at the cover inner peripheral edge portion 435 that is closest to the inner side in the radial direction Dr around the axis O. Therefore, the rigidity of the cover inner peripheral edge portion 435 formed at a position separated from the blades 42 is increased. Therefore, it is possible to more effectively suppress the influence of a centrifugal force acting on the cover 43.

In addition, a section of each connection member 60A that is orthogonal to a direction in which the disk 41 and the cover 43 are connected to each other has a circular shape. Therefore, it is possible to suppress pressure loss at the time of collision between the process gas G flowing in through the inlet 451 and the connection member 60A. Accordingly, it is possible to suppress an increase in pressure loss caused when the connection members 60A are provided.

In addition, with such an impeller 40, it is possible to increase the rotation rate of the impeller 40 and to provide the rotary machine 10 that can be operated with high-speed rotation.

(Other Embodiments)

Hereinabove, the embodiment of the present disclosure has been described in detail with reference to the drawings. However, a specific configuration is not limited to the embodiment and also includes design changes and the like not departing from the spirit of the present disclosure.

Figure 6:
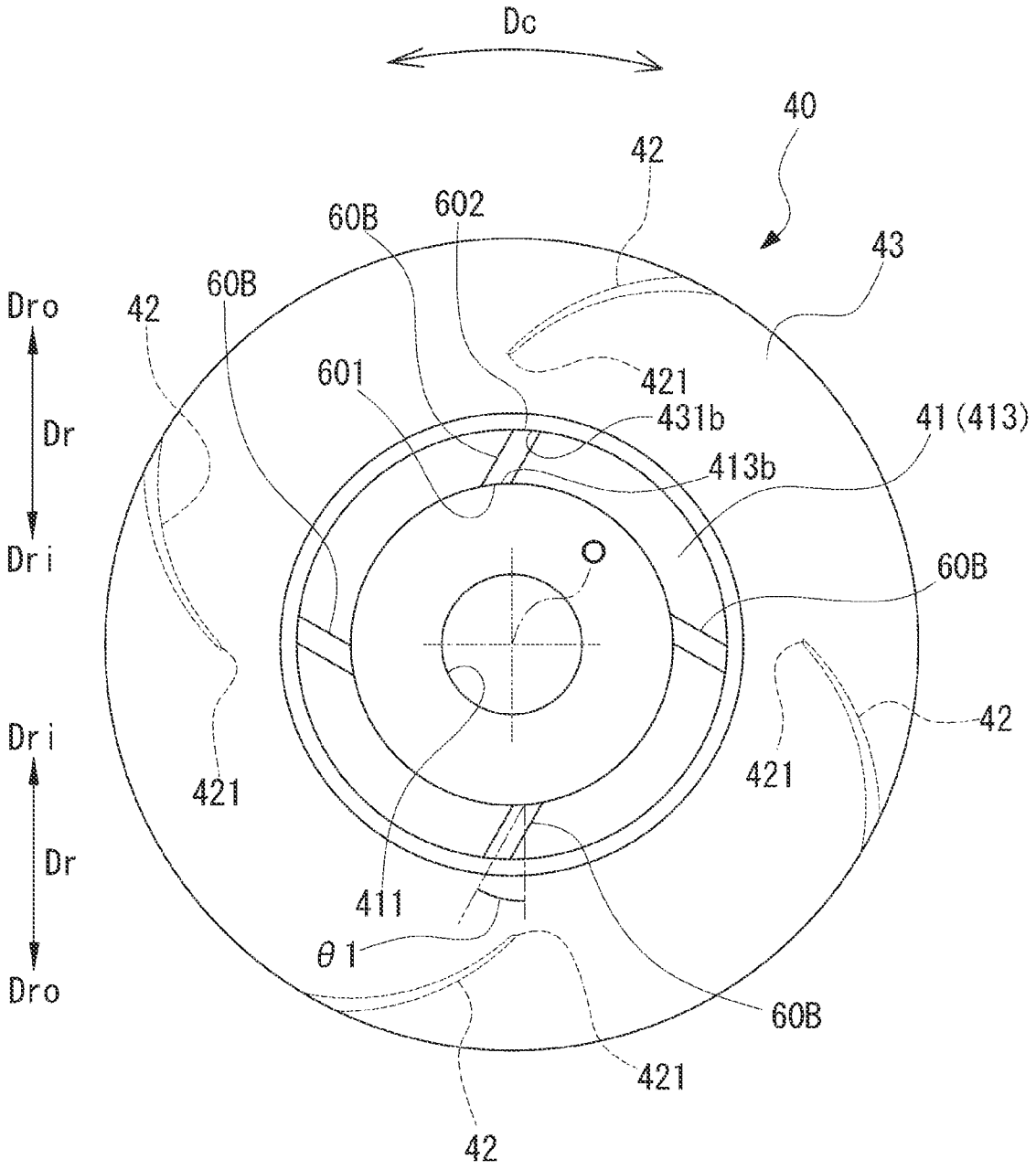
FIG. 6 is a view showing a modification example of connection members provided in the impeller.

For example, in the above-described embodiment, the extending direction of each connection member 60A in which the disk side end portion 601 and the cover side end portion 602 are connected to each other is parallel to the radial direction Dr as seen in the axial direction Da. However, the present disclosure is not limited thereto. For example, as shown in FIG. 6, the extending direction of each connection member 60B in which the disk side end portion 601 and the cover side end portion 602 are connected to each other may be inclined with respect to the radial direction Dr as seen in the axial direction Da. In this case as well, it is preferable that an angle of inclination θ1 of the connection member 60B with respect to the radial direction Dr is smaller than the angle of inclination θ2 of the front edge 421 with respect to the radial direction Dr, as seen in the axial direction Da.

In addition, in FIG. 3 in the above-described embodiment, the number of the connection members 60A is the same as the number of the blades 42. However, the number of the connection members 60A may be different from the number of the blades 42.

In addition, in FIG. 3 in the above-described embodiment, each connection member 60A is positioned at the same position as the front edge 421 of the blade 42 in the circumferential direction Dc. However, the position of the connection member 60A in the circumferential direction Dc may be different from that of the blade 42. In this case, as seen in the axial direction Da, the connection member 60A may be disposed at a position relative to the blade 42 in the circumferential direction De such that the connection member 60A does not overlap the front edge 421 of the blade 42.

Figure 7:
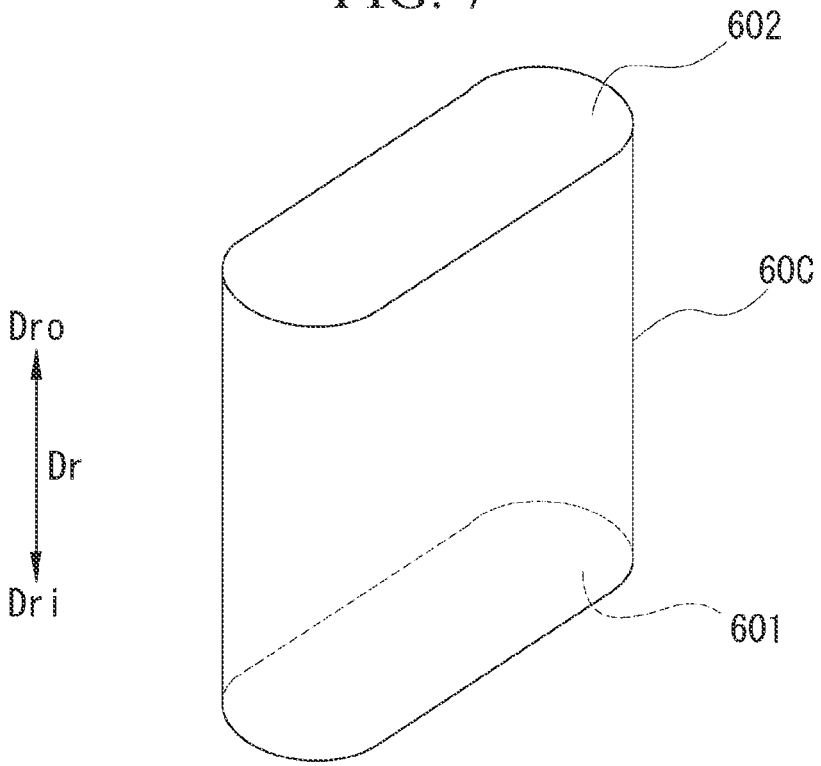
FIG. 7 is a view showing a modification example of the shape of the connection member provided in the impeller.

In addition, in the above-described embodiment, the shape of a section of each connection member 60A that is orthogonal to the extending direction is circular. However, the shape of the connection member is not limited to such a shape. For example, as shown in FIG. 7, the shape of a section of a connection member 60C that is orthogonal to an extending direction may be an oval shape. In this case, it is preferable that the longitudinal direction of the connection member 60 of which the sectional shape is an oval shape is parallel to a direction in which the process gas G flows so that loss of pressure applied with respect to a stream of the process gas G at the inlet 451 is suppressed.

Figure 8:
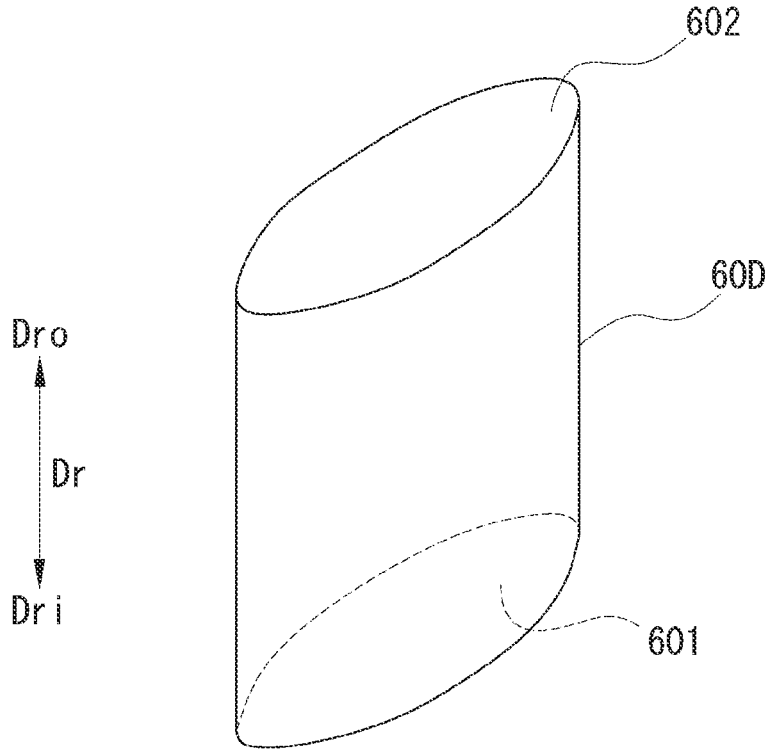
FIG. 8 is a view showing a modification example of the shape of the connection member provided in the impeller.
Figure 9:
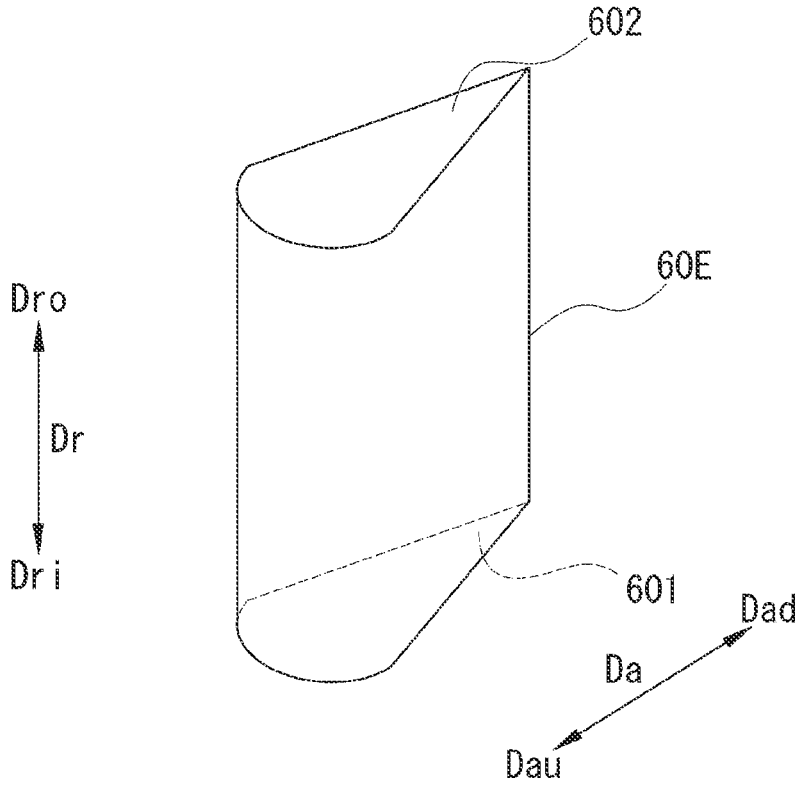
FIG. 9 is a view showing a modification example of the shape of the connection member provided in the impeller.
Figure 10:
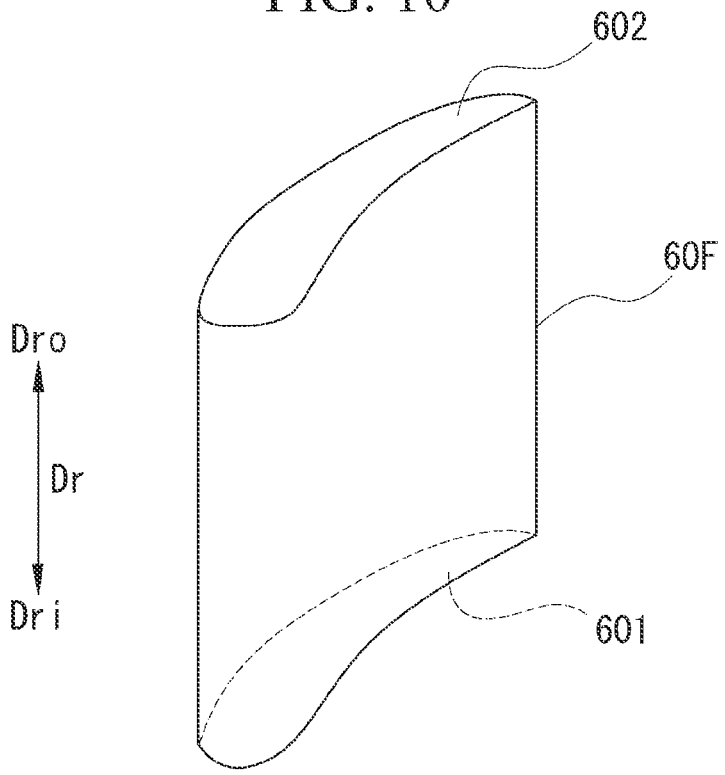
FIG. 10 is a view showing a modification example of the shape of the connection member provided in the impeller.
Figure 11:
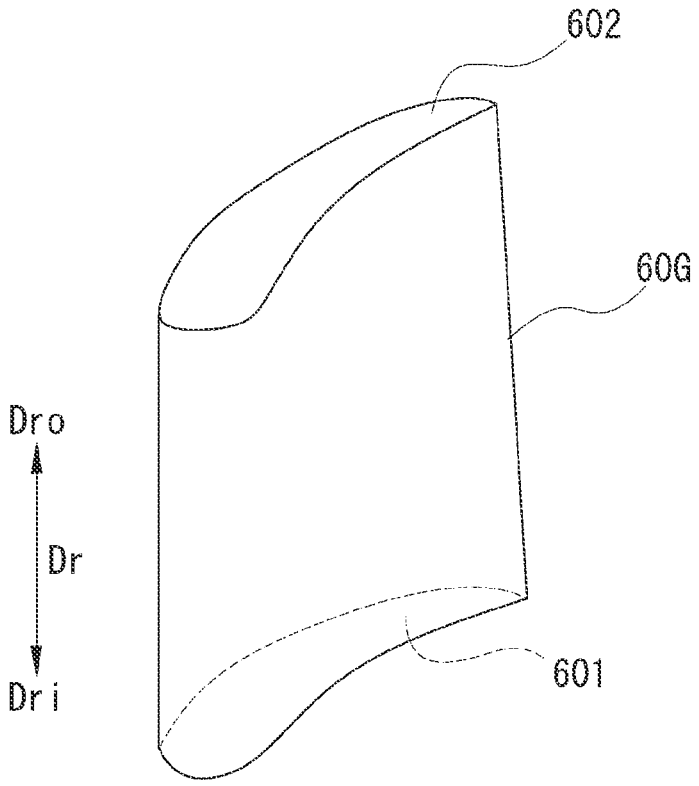
FIG. 11 is a view showing a modification example of the shape of the connection member provided in the impeller.

In addition, as shown in FIG. 8, the shape of a section of a connection member 60D that is orthogonal to an extending direction may be an elliptical shape. In addition, as shown in FIG. 9, the shape of a section of a connection member 60E that is orthogonal to an extending direction may be a teardrop shape of which a front edge on the first side Dau in the axial direction Da is semicircular and of which the width dimension gradually decreases toward the second side Dad in the axial direction Da. In addition, as shown in FIG. 10, the shape of a section of a connection member 60F that is orthogonal to the extending direction may be an airfoil shape. Furthermore, as shown in FIG. 11, a connection member 60G may be formed to be twisted around the radial direction Dr from the disk side end portion 601 to the cover side end portion 602. Note that, although the sectional shape of the connection member 60G is an airfoil shape in FIG. 11, the sectional shape may be another shape.

In addition, a method of manufacturing the impeller 40 in the above-described embodiment is not particularly limited. For example, the impeller 40 may be divided into the disk 41, the blades 42, and the cover 43. Further, the impeller 40 may be integrally formed with the disk 41, the blades 42, the cover 43, and the connection members 60A to 60G by means of a three-dimensional lamination molding method or the like.

APPENDIX

The impeller 40 and the rotary machine 10 described in the embodiment can be understood as follows, for example.

(1) The impeller 40 according to a first aspect includes the disk 41 that has a disk shape centered on the axis O, the cover 43 that is disposed to be separated from the disk 41 in the axial direction Da in which the axis O extends, the plurality of blades 42 that connect the disk 41 and the cover 43 to each other and are disposed at intervals in the circumferential direction Dc around the axis O, and the connection member 60A that is disposed to be separated from the plurality of blades 42 in the axial direction Da and connects the disk 41 and the cover 43 to each other. A plurality of the connection members 60A are disposed at intervals in the circumferential direction Dc at positions near the inlet 451 of the impeller flow path 45 with respect to the front edges 421 of the blades 42 positioned at positions near the inlet 451, the impeller flow path 45 being formed between the disk 41 and the cover 43.

In the case of the impeller 40, the disk 41 and the cover 43 are connected to each other by means of the plurality of connection members 60A independently of the blades 42. Accordingly, the cover 43 is supported by the plurality of connection members 60A at a portion closer to the inlet 451 than the plurality of blades 42. Therefore, the rigidity of a portion of the cover 43 that is closer to the inlet 451 than the plurality of blades 42 is made high without an increase in weight of the cover 43. As a result, it is possible to suppress the influence of a centrifugal force acting on the cover 43 while achieving an increase in rigidity of the cover 43 in a region where no blade 42 is disposed. Accordingly, it is possible to increase the rotation rate of the impeller 40.

(2) The impeller 40 according to a second aspect is the impeller 40 related to (1) in which a meridional shape of the connection member extends to be perpendicular to the axis.

Accordingly, it is possible to improve the rigidity of the connection member 60A. Accordingly, it is possible to effectively suppress the influence of a centrifugal force (stress caused by centrifugal load) acting on the cover 43.

(3) The impeller 40 according to a third aspect is the impeller 40 related to (1) or (2) in which, as seen in the axial direction Da, the connection member 60A extends such that the angle of inclination θ1 of the connection member 60A with respect to the radial direction Dr around the axis O is smaller than the angle of inclination θ2 of the meridional shape of the front edge 421 of the blade 42 with respect to the radial direction Dr.

Accordingly, the angle of inclination θ1 of the connection member 60A with respect to the radial direction Dr is small as seen in the axial direction Da. Therefore, it is possible to more efficiently support the cover 43 and to effectively increase the rigidity of the cover 43 against a centrifugal force acting in the radial direction Dr.

(4) The impeller 40 according to a fourth aspect is the impeller 40 related to any one of (1) to (3) in which, the disk side end portion 601 and the cover side end portion 602 of the connection member 60A are disposed at the same position in the circumferential direction Dc as seen in the axial direction Da, the disk side end portion 601 being connected to the disk 41 and the cover side end portion 602 being connected to the cover 43.

Accordingly, it is possible to make the connection member 60A extend substantially straight in the radial direction Dr. Accordingly, with the connection member 60A, it is possible to more efficiently support the cover 43 and to effectively increase the rigidity of the cover 43 against a centrifugal force acting in the radial direction Dr.

(5) The impeller 40 according to a fifth aspect is the impeller 40 related to any one of (1) to (4) in which, the connection member 60A is connected to the cover 43 at the cover inner peripheral edge portion 435 that is positioned at an innermost side in the radial direction Dr around the axis O.

Accordingly, the rigidity of the cover inner peripheral edge portion 435 of the cover 43 is increased by the connection member 60A. Therefore, the rigidity of the cover inner peripheral edge portion 435 formed at a position separated from the blades 42 is increased. Therefore, it is possible to more effectively suppress the influence of a centrifugal force acting on the cover 43.

(6) The rotary machine 10 according to a sixth aspect includes the impeller 40 related to any one of (1) to (5).

Examples of the rotary machine 10 include a centrifugal compressor or the like.

Accordingly, it is possible to increase the rotation rate of the impeller 40 and to provide the rotary machine 10 that can be operated with high-speed rotation.

EXPLANATION OF REFERENCES

10: centrifugal compressor (rotary machine)
20: casing
20*a*: first end portion
20*b*: second end portion
24: internal space
25: suction port
26: discharge port
28A, 28B: journal bearing
29: thrust bearing
30: rotary shaft
40: impeller
41: disk
411: through-hole
413: disk main surface (surface)
413*a*: portion
413*b*: portion
42: blade
421: front edge
43: cover
431: cover facing surface
431*a*: portion
431*b*: portion
435: cover inner peripheral edge portion
45: impeller flow path
451: inlet
452: outlet
50: casing side flow path
51: diffuser portion
52: return bend portion
53: return flow path
60A to 60*i*: connection member
601: disk side end portion
602: cover side end portion
Da: axial direction
Dad: second side
Dau: first side
Dc: circumferential direction
Dr: radial direction
Dri: inner side
Dro: outer side
G: process gas
O: axis
θ1, θ2: angle of inclination

What is claimed is:

1. An impeller comprising:
a disk that has a disk shape centered on an axis;
a cover that is disposed to be separated from the disk in an axial direction in which the axis extends;
blades that connect the disk and the cover to each other and are disposed at intervals in a circumferential direction around the axis; and
connection members that are disposed separate from the blades in the axial direction and connect the disk and the cover to each other, wherein
the connection members are disposed at intervals in the circumferential direction at positions near an inlet of an impeller flow path with respect to front edges of the blades positioned at positions near the inlet, the impeller flow path being formed between the disk and the cover,
a number of the connection members is equal to a number of the blades,
each of the connection members is disposed at a same position as a front edge of each of the blades in the circumferential direction, and
a shape of a section orthogonal to an extending direction of each of the connection members is circular.

2. The impeller according to claim 1, wherein a meridional shape of the connection members extends to be perpendicular to the axis.

3. The impeller according to claim 1, wherein, as seen in the axial direction, each of the connection members extends such that an angle of inclination thereof with respect to a radial direction around the axis is smaller than an angle of inclination of the front edge with respect to the radial direction.

4. The impeller according to claim 1, wherein a disk side end portion and a cover side end portion of each of the connection members are disposed at the same position in the circumferential direction as seen in the axial direction, the disk side end portion being connected to the disk and the cover side end portion being connected to the cover.

5. The impeller according to claim 1, wherein each of the connection members is connected to the cover at a cover inner peripheral edge portion that is positioned at an innermost side in a radial direction around the axis.

6. A rotary machine comprising:
an impeller according to claim 1.

* * * * *